US006078881A

United States Patent [19]

Ota et al.

[11] Patent Number: 6,078,881

[45] Date of Patent: Jun. 20, 2000

[54] SPEECH ENCODING AND DECODING METHOD AND SPEECH ENCODING AND DECODING APPARATUS

[75] Inventors: Yasuji Ota; Hitoshi Matsuzawa; Masanao Suzuki, all of Kawasaki, Japan

[73] Assignee: Fujitsu Limited, Kanagawa, Japan

[21] Appl. No.: 09/033,198

[22] Filed: Mar. 2, 1998

[30] Foreign Application Priority Data

Oct. 20, 1997 [JP] Japan ..... 9-286373

[51] Int. Cl.[7] ..... G10L 101/10

[52] U.S. Cl. ..... 704/222; 704/223

[58] Field of Search ..... 704/221, 222, 704/223

[56] References Cited

U.S. PATENT DOCUMENTS 5,819,213 10/1998 Oshikiri ..... 704/222

5,864,650 1/1999 Taniguchi et al. ..... 704/220

OTHER PUBLICATIONS

Kondoz, "Digital Speech" Wiley, 190–194, 1994.

*Primary Examiner*—David R. Hudspeth
*Assistant Examiner*—Harold Zintel
*Attorney, Agent, or Firm*—Helfgott & Karas, P.C.

[57] ABSTRACT

Speech encoding using searching of a code book for a code that matches an input speech signal, and speech decoding using the code book are disclosed. A random series of code samples is stored in a buffer memory such as a ring buffer memory, and a basic vector generation unit generates basic vectors by applying an arbitrary shift to each of code series retrieved from the random series. Generation of the basic vectors may be performed according to, for example, an overlapping vector generation process. A code book generation unit extends the basic vectors contained in a basic vector unit according to a structuring process so as to produce a tree-structured delta code book. The basic vector generation unit may extend the basic vectors based on pitch parameters or a center clipping threshold.

8 Claims, 17 Drawing Sheets

$$B_orth = B - \frac{(HP)^{\tau}(HB)}{(HP)^{\tau}(HP)} P$$

$$= B - \frac{P^{\tau} H^{\tau} HP}{(HP)^{\tau}(HP)} B$$

$$= \left[1 - \frac{P^{\tau} H^{\tau} HP}{(HP)^{\tau}(HP)}\right] B$$

$$= GB$$

SPEECH ENCODING AND DECODING METHOD AND SPEECH ENCODING AND DECODING APPARATUS

BACKGROUND OF THE INVENTION

1. Field of the Invention

The present invention generally relates to speech encoding and decoding methods and speech encoding and decoding apparatuses of an A-b-S (Analysis-by-Synthesis) type using vector quantization, and, more particularly, to a speech encoding and decoding method and a speech encoding and decoding apparatus in which a memory size is reduced and the volume of computation is reduced.

The A-b-S vector quantization speech encoding and decoding method, as represented by Code Excited Linear Prediction (CELP) coding method, is used to compress a speech signal into a signal having a rate of 4–6 kbps. Such a speech compression process is used in a communication system in private organizations and is also used to provide an efficient digital mobile wireless system. In the field of speech compression, there is a growing demand for reduction of the volume of process and of the hardware size.

2. Description of the Related Art

In the A-b-S vector quantization speech encoding and decoding method, a code vector is determined so as to minimize a power difference between an input signal and a reproduced signal produced on the basis of the code vector.

FIG. 1 is a block diagram showing a concept of the A-b-S vector quantization speech encoding and decoding. Referring to FIG. 1, an A-b-S vector quantization speech encoding and decoding apparatus comprises a code book 61, a coefficient provider 62, a linear predictive synthesis filter 63, a subtractor 64 and a error estimation unit 65 for estimating an error signal power.

The code book 61 stores a plurality of code vectors C. The coefficient provider 62 multiplies the code vector C by a gain g. An output gC of the coefficient provider 61 is input to the linear predictive synthesis filter 63 so as to output a reproduced signal gAC. The reproduced signal gAC and the input signal X are input to the subtractor 64 so as to produce an error signal E. The error estimation unit 65 searches for a code vector that minimizes the power difference indicated by the error signal E. The error estimation unit 65 outputs an index indicating the candidate code vector as encoding information. When the error estimation unit 65 receives the encoding information, it reads out the code vector corresponding to the index from the code book so that the speech is reconstructed.

FIG. 2 is a block diagram of an apparatus operated on CELP according to the related art. Referring to FIG. 2, the CELP apparatus comprises a stochastic code book 71, an adaptive code book 72, coefficient providers 73 and 74, linear predictive synthesis filters 75 and 78, subtractors 76 and 79, and error estimation units 77 and 80. The stochastic code book 71 is adapted for random speech source, the adaptive code book 72 is adapted for pitch speech source. The adaptive code vectors stored in the adaptive code book 72 are adaptively updated, and the stochastic code vectors stored in the stochastic code book 71 are designated as a fixed code book.

The code vector C from the stochastic code book 71 is multiplied by a gain g. The linear predictive synthesis filter 75 produces a reproduced signal gAC based on an output gC of the coefficient provider 73. An error signal E indicating a difference between the reproduced signal gAC and the input signal y is obtained. The code vector C that minimizes the power difference indicated by the error signal E is identified. Similarly, the adaptive code vector (pitch vector) P from the adaptive code book 72 is multiplied by a gain b. The linear predictive synthesis filter 78 produces a reproduced signal bAP based on an output bP of the coefficient provider 74. An error signal indicating a difference between the reproduced signal bAP and the input signal X is obtained. The code vector that minimizes the power difference indicated by the error signal is identified.

The stochastic code book 71 stores a large number of stochastic code vectors adapted for a random speech source. Therefore, a considerable memory size is required to constitute the stochastic code book 71. For example, given the vector dimension size=40 (corresponding to 8 kHz sampling for a duration of 5 ms) and the basic vector count M=1024, a memory size of 40960 words is required. Accordingly, there have been proposals for an overlapping code book and a structured code book that meet the requirement for reduction of the size of the memory constituting the stochastic code book.

FIGS. 3A and 3B show the overlapping code book according to the related art. FIG. 3A is a schematic block diagram showing vector quantization using the overlapping code book. FIG. 3B shows how overlapping vectors are generated. Referring to FIG. 3A, the vector quantization system using the overlapping code book comprises a random series 81, an overlapping code book generation unit 82, a stochastic code book 83 as an overlapping code book, a coefficient provider 84, a linear predictive synthesis filter 85, a subtractor 86, and a error estimation unit 87. The random series 81 is random speech information for coding and decoding purposes. The process for identifying the code vector executed by the stochastic code book 83 is the same as that described with reference to FIGS. 1 and 2, and the description thereof will be omitted.

As shown in FIG. 3B, the random series 81 at least has a size of N+(M−1)K where N indicates a vector dimension size, M indicates a basic vector count and K indicates a shift. The overlapping code book generation unit 82 retrieves code vectors having the vector dimension size N from the random series 81 in accordance with the shift K, so that the stochastic code book 83 having the basic vector count M is formed.

Assuming that N=40, M=1024 and K=1, N+(M−1)K=1063 (words). The memory size is 1/40 that of the stochastic code book storing the code vectors of N=40 in accordance with the basic vector count M=1024 and having a memory size of 40960 words.

FIGS. 4A and 4B show the structured code book according to the related art. FIG. 4A is a schematic block diagram showing vector quantization using the structured code book. FIG. 4B shows how a tree-structured delta code is generated. Referring to FIG. 4A, the vector quantization system using the tree-structured code book comprises a basic vector unit 91, a code book generation unit 92 that operates on vector addition and subtraction, a stochastic code book 93, a coefficient provider 94, a linear predictive synthesis filter 95, a subtractor 96 and a error estimation unit 97. The process for identifying the code vector executed by the stochastic code book 93 is the same as that described with reference to FIGS. 1 and 2, and the description thereof will be omitted.

Referring to the tree structure of FIG. 4B, the basis vector unit 91 stores an initial vector $C_0$ and delta vectors $\Delta C_1$, $\Delta C_2$, . . . $\Delta C_9$ each associated with a respective layer. The code book generation unit 92 produces code vectors by addition and subtraction of the basic vectors $C_0$, $\Delta C_1$, $\Delta C_2$, . . . $\Delta C_9$, so as to generate the stochastic code book 93. For example, using the initial vector $C_0$ and the delta vectors $\Delta C_1$ and $\Delta C_2$, the code book generation unit 92 produces code vectors $C_0$–$C_4$ as follows.

$C_0=C_0+0$ $C_1=C_0+\Delta C_1$ $C_2=C_0-\Delta C_1$ $C_3=C_1+\Delta C_2=C_0+\Delta C_1+\Delta C_2$ $C_4=C_1-\Delta C_2=C_0+\Delta C_1-\Delta C_2$ Similarly, the code vectors $C_{1021}$ and $C_{1022}$ are obtained as follows.

$C_{1021}=C_{510}+\Delta C_9=C_0-\Delta C_1-\Delta C_2- \ldots +\Delta C_9$ $C_{1022}=C_{510}-\Delta C_9=C_0-\Delta C_1-\Delta C_2- \ldots -\Delta C_9$ Thus, the stochastic code book 93 including the code vectors $C_0$, $C_1$, $C_2$, $C_3$, . . . $C_{1022}$ can be generated.

In this case, by storing a total of ten vectors including the initial vector $C_0$ and the nine delta vectors $\Delta C_1$–$\Delta C_9$ in the basic vector unit 91, a total of 1023 code vectors can be generated. Accordingly, the basic vector unit 91 need only have a memory size of 400 words ($N \cdot \log_2 M=40 \cdot 10=400$), given that the vector dimension size N=40 and the basic vector count M=1024. Accordingly, the memory size is 1/100 that of the stochastic code book storing the code vectors of N=40 in accordance with the basic vector count M=1024 and having a memory size of 40960 words.

The structured code book described above is disclosed in Japanese Laid-Open Patent Application No. 5-158500.

The overlapping code book shown in FIGS. 3A and 3B enables reduction of a memory size from $N \cdot M$ to $N+(M-1)K$. The structured code book shown in FIGS. 4A and 4B enables reduction of a memory size to $N \cdot \log_2 M$. However, since the A-b-S vector quantization speech encoding is applied to a mobile telephone system, further reduction of a memory size and total amount of computation is called for.

SUMMARY OF THE INVENTION

Accordingly, an object of the present invention is to provide a speech encoding and decoding method and a speech encoding and decoding apparatus in which a memory size is reduced and the volume of computation is reduced.

The aforementioned object can be achieved by a speech signal encoding decoding method using A-b-S vector quantization comprising the steps of: generating basic vectors having a predetermined vector dimension size by applying an arbitrary shift to a code sample retrieved from a random series of code samples; and generating code vectors constituting a code book, by extending said basic vectors according to a structuring process.

The aforementioned object may also be achieved by a speech signal encoding and decoding apparatus using A-b-S vector quantization comprising: a buffer memory for storing a random series of code samples; a basic vector generation unit for generating basic vectors from code series retrieved from said buffer memory, on the basis of parameters including a vector dimension size and a shift, and according to an overlapping vector generation process; and a code book generation unit for generating a code book by extending the basic vectors generated by said basic vector generation unit.

According to the speech encoding and decoding method and apparatus of the present invention, as a result of using the overlapping vector generation process, a memory size and a volume of computation are reduced. By executing a basic vector generation process in a stage that precedes an extending process for generating a code book, distribution of the code vectors that constitute the code book can be easily controlled.

By storing the random series in a ring buffer memory and by generating the basic vectors using the overlapping vector generation process, the code samples at the head of the random series are efficiently used so that the size of the ring buffer memory for storing the random series can be further reduced. By extending the basic vectors into a structured code book such as a tree-structured delta code book, the basic vector count can be reduced.

The number of zero-amplitude samples in the basic vectors can be controlled, using comparison of the threshold with the parameter obtained by an analysis in a preceding stage included a process for identifying a code in the code book that matches the input signal, or with the received parameter, or with the parameter obtained by a re-analysis. With this arrangement, the code book with a variable density of non-zero samples can be produced. The code book thus produced covers a wide range of speech including voiced sounds for which a pulse excitation signal is most adapted, and unvoiced sounds for which a noiselike excitation signal is most adapted. Thus, the encoding and decoding performance is improved.

By processing code series each having the vector dimension size and retrieved from the random series so as to produce orthogonal vectors having no correlation with the pitch vector, all of the basic vectors can be generated as vectors having no correlation with the pitch vector before being extended to produce the code book. Accordingly, efficiency of quantization is improved. By applying a pitch enhancement process when the pitch period is shorter than an analyzed frame length, quality of decoded and reconstructed speech signals is improved.

BRIEF DESCRIPTION OF THE DRAWINGS

Other objects and further features of the present invention will be apparent from the following detailed description when read in conjunction with the accompanying drawings: in which.

DETAILED DESCRIPTION OF THE PREFERRED EMBODIMENTS

Figure 5:
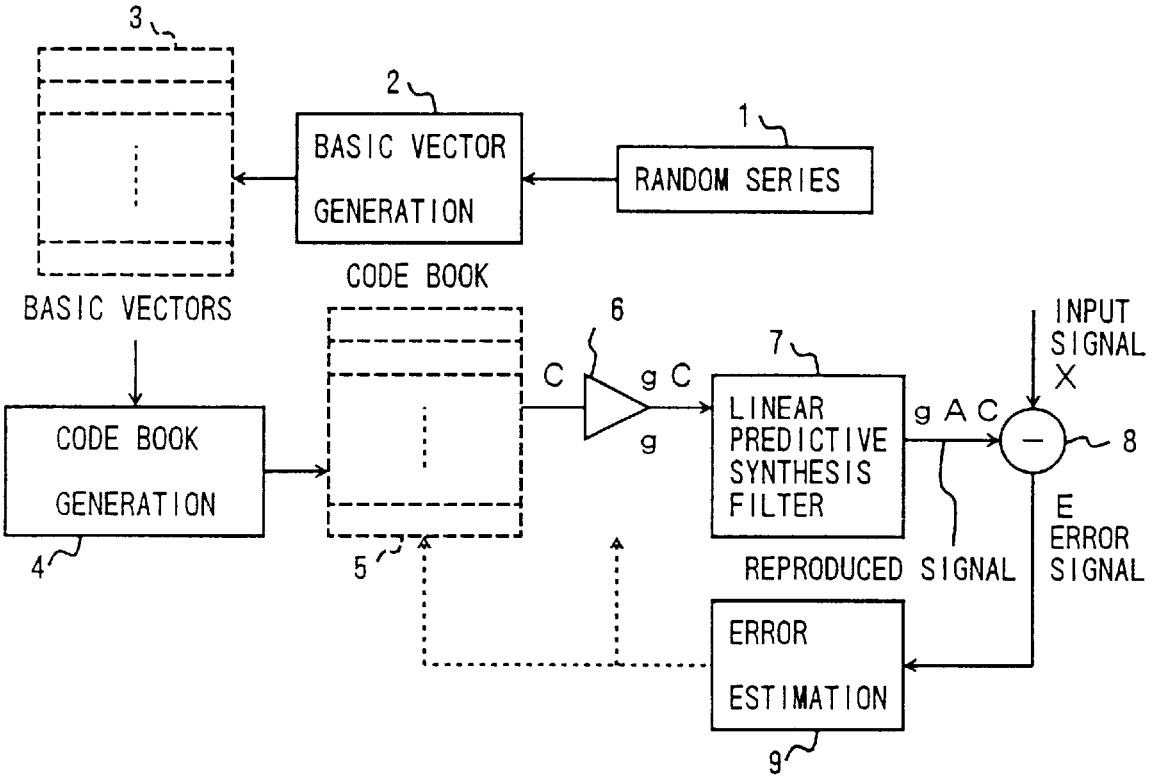
FIG. 5 is a block diagram showing a basic principle of a speech encoding and decoding apparatus according to the present invention.

FIG. 5 is a block diagram showing an operating principle of a speech encoding and decoding apparatus according to the present invention. The apparatus comprises a random series 1, a basic vector generation unit 2, a basic vector unit 3, a code book generation unit 4, a code book 5, a coefficient provider 6, a linear predictive synthesis filter 7, a subtractor 8 and a error estimation unit 9. The basic vector unit 3 and the code book 5 (which corresponds to the structured code book) are generated in the process according to the present invention and are indicated by broken lines. The function of each of the components of the apparatus can be easily implemented by an operation of a microprocessor or the like.

The basic vector generation unit 2 receives the random series and generates basic vectors having a predetermined vector dimension size in accordance with an arbitrary shift. The resultant basic vectors constitute the basic vector unit 3. For example, overlapping vector generating means may be used to implement the basic vector generation unit 2. Hereinafter, overlapping vector generation refers to a process of generating basic vectors where two sets of basic vectors share common vectors. The code book generation unit 4 performs a structuring process by generating the code book 5 (structured code book) using the basic vector unit 3. The code vector C from the code book 5 is multiplied by a gain g in the coefficient provider 6. The output gC of the coefficient provider 6 is processed by the linear predictive synthesis filter 7 to produce a reproduced signal gAC. The subtractor 8 produces an error signal E indicating a difference between the reproduced signal gAC and the input signal X. The error estimation unit 9 estimates a power difference indicated by the error signal E so as to select an optimum code vector that produces a minimum power difference. The error estimation unit 9 outputs an index corresponding to the code vector C as encoding information.

A decoding apparatus receiving encoding information identifies the code vector in the code book. The decoding apparatus reconstructs a speech signal using a synthesis filter similar to the linear predictive synthesis filter 7, based on parameters including the code vector identified, the gain, the pitch period and the like. The code book used in decoding may also be generated such that basic vectors are generated from the random series 1 according to overlapping vector generation and the basic vectors are extended by the structuring process to produce the tree-structured delta code book.

As described before, the basic vectors for producing the code vectors of the code book may be produced by extending the random series 1 by an overlapping process. Therefore, the random series 1 can be considerably small in size. Thus, a memory size can be considerably reduced.

When the basic vectors are produced by the overlapping process, the volume of computation can be reduced by using correlation between adjacent code vectors.

It is to be noted that, in the case of the structured code books such as that of the Vector Sum Excited Linear Prediction or the tree-structured delta code book, the basic vectors are weighted according to human auditory response. If, for example, a large portion of a plurality of sample series produces an overlap (that is, if a shift is small), matrix computation for the basic vectors may be replaced by updating computation for several samples so that the volume of computation is reduced.

Figure 1:
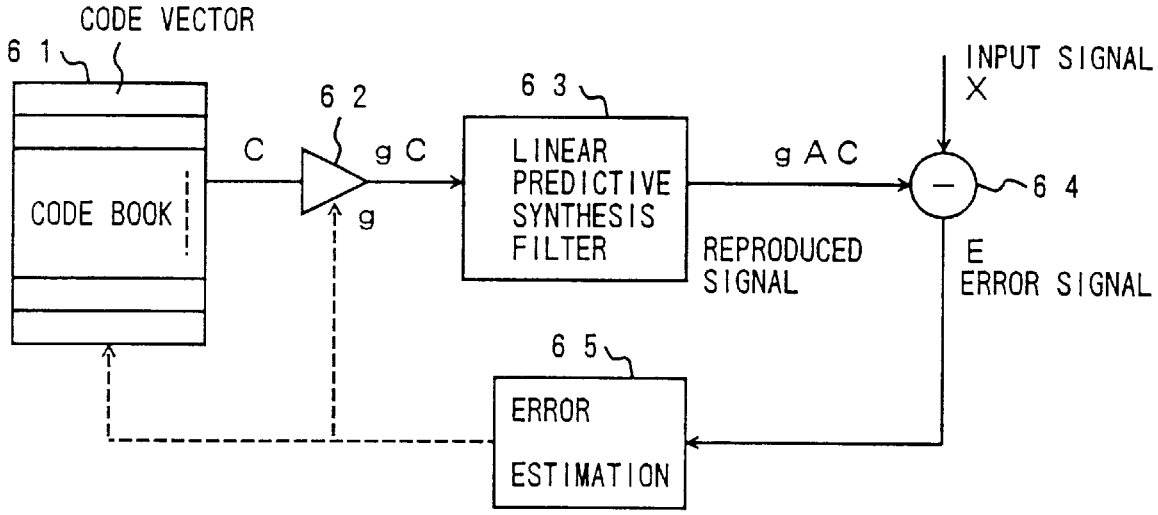
FIG. 1 PRIOR ART
FIG. 1 is a block diagram showing a concept of the A-b-S vector quantization speech encoding and decoding.
Figure 2:
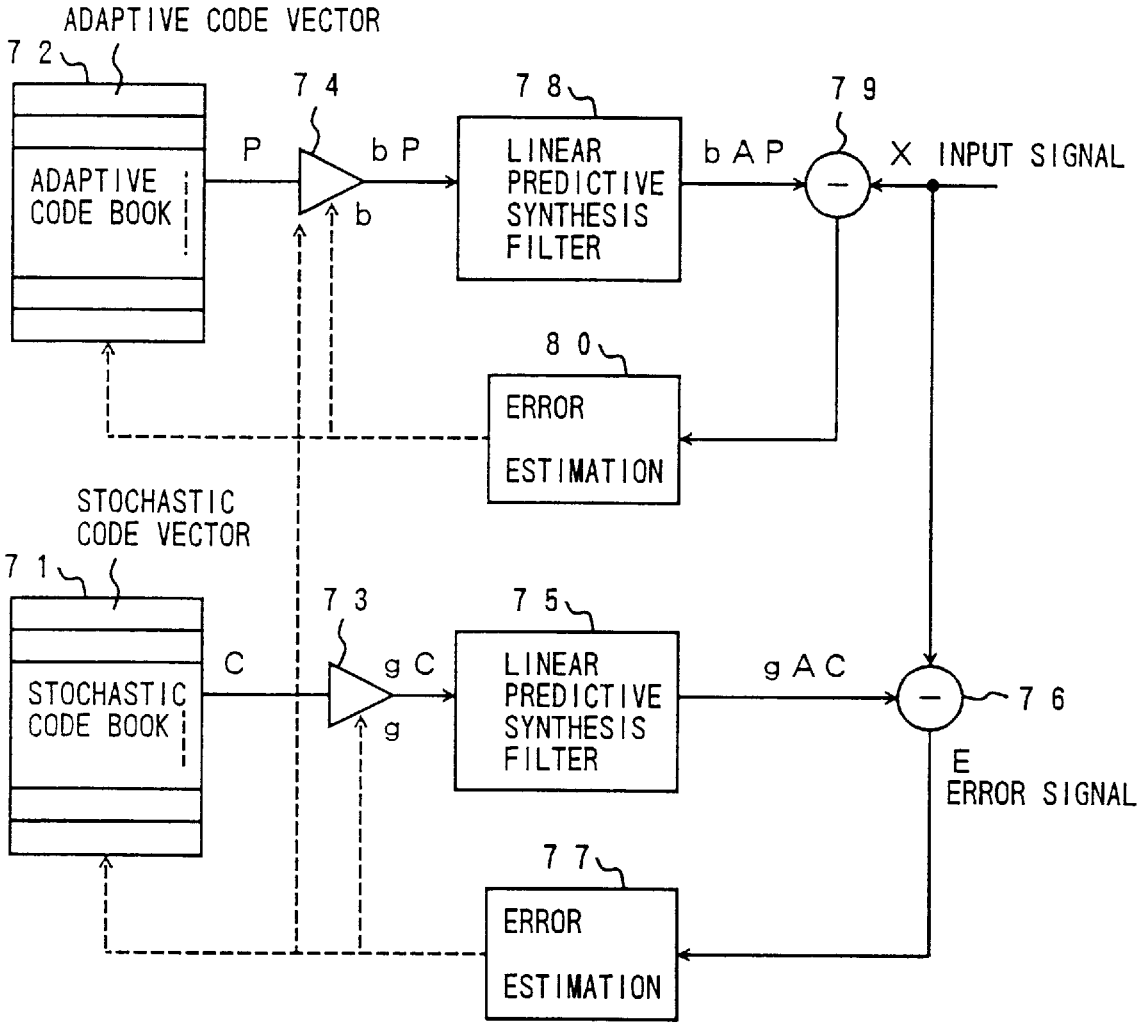
FIG. 2 PRIOR ART
FIG. 2 is a block diagram of a CELP apparatus according to the related art.
Figure 3A:
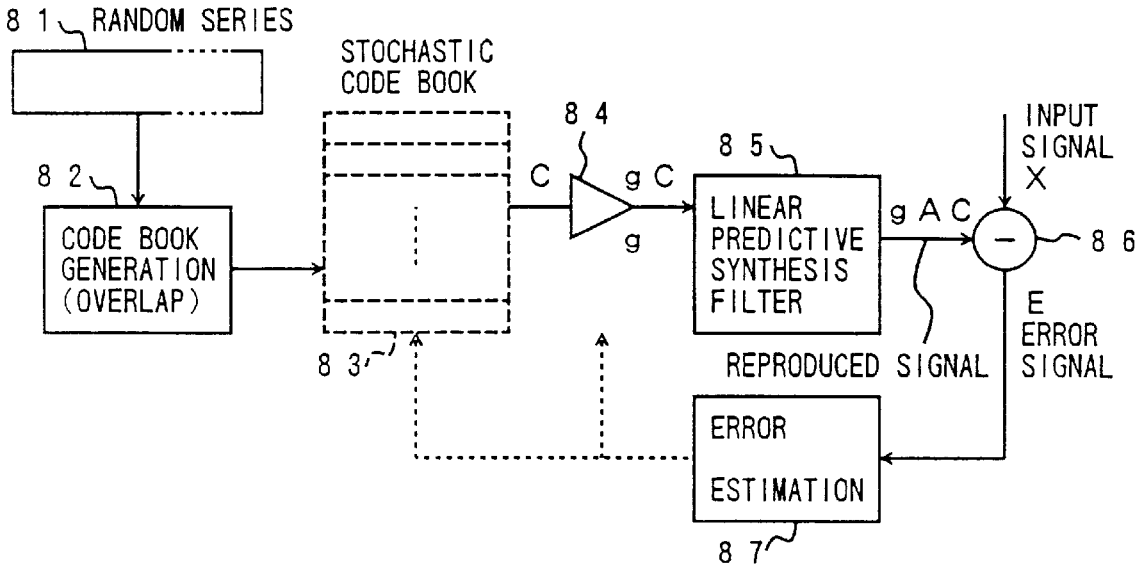
FIG. 3A PRIOR ART
FIG. 3A is a schematic block diagram showing vector quantization using an overlapping code book.
Figure 3B:
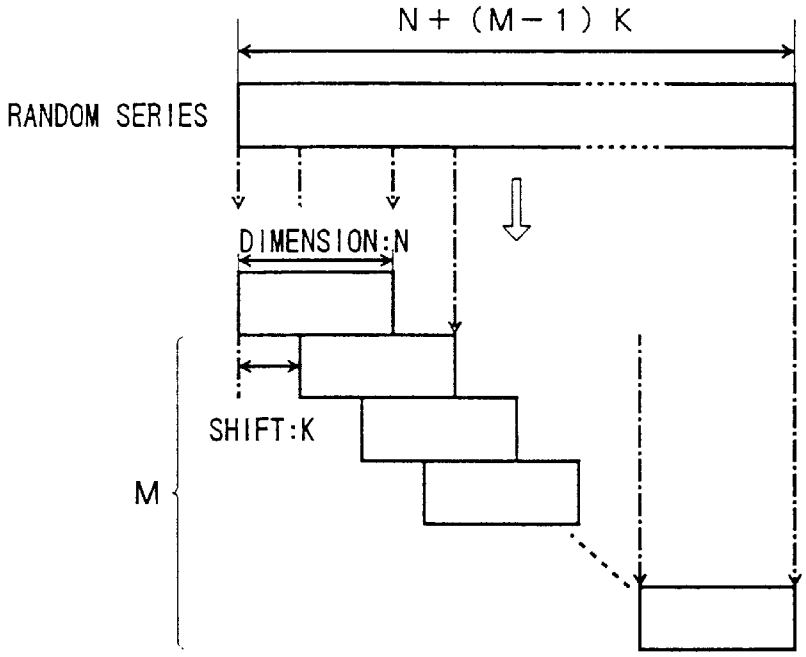
FIG. 3B PRIOR ART
FIG. 3B shows how overlapping vectors are generated.
Figure 4A:
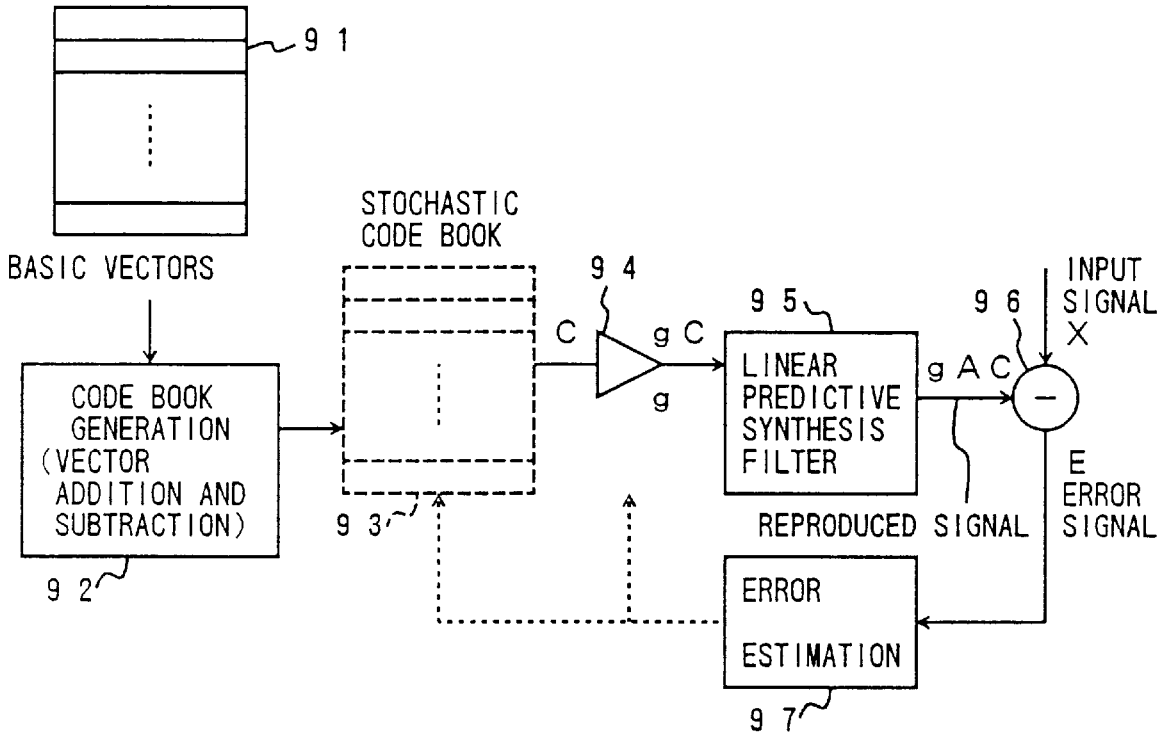
FIG. 4A PRIOR ART
FIG. 4A is a schematic block diagram showing vector quantization using a structured code book.
Figure 4B:
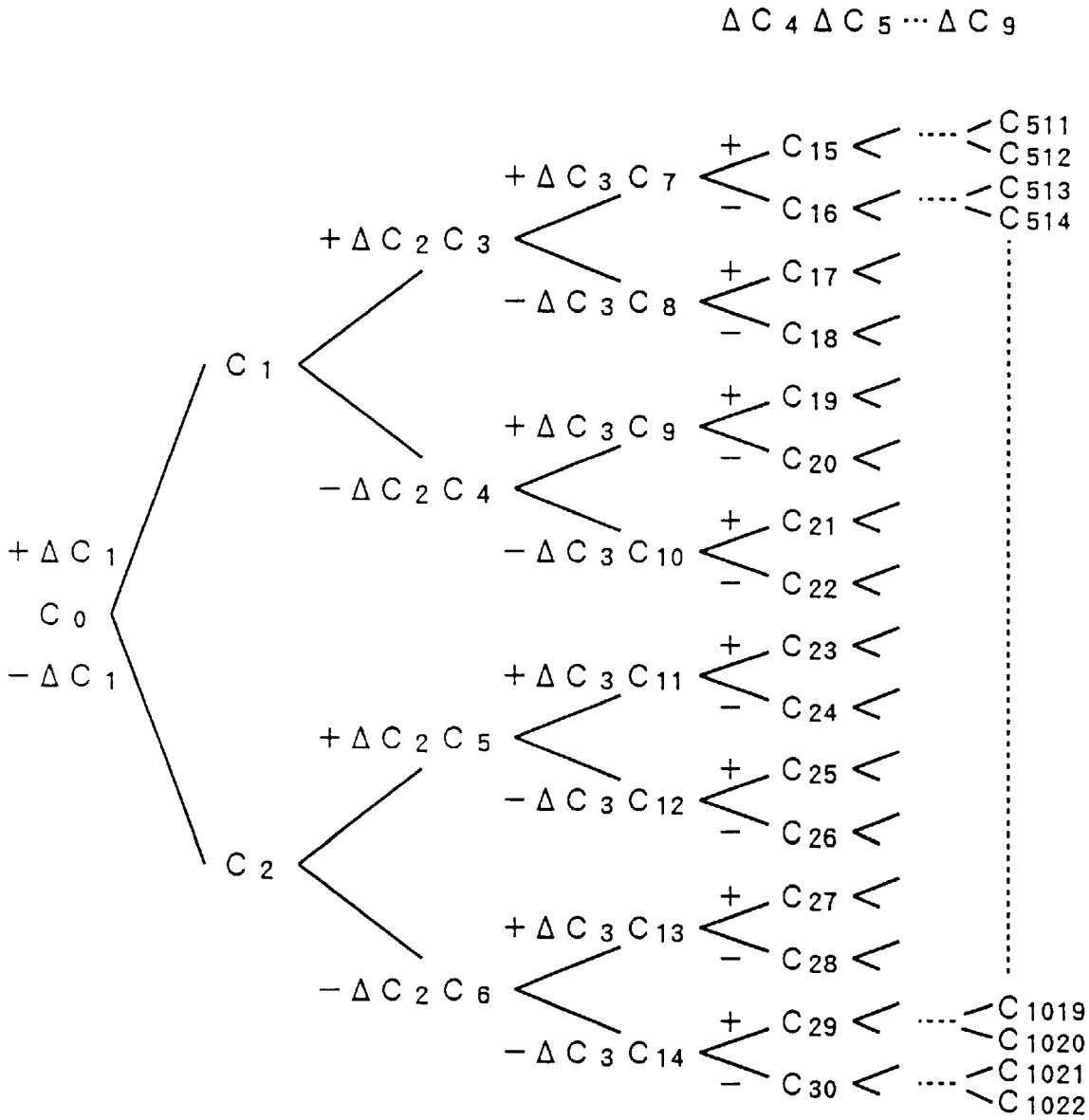
FIG. 4B PRIOR ART
FIG. 4B shows how a tree-structured delta code is generated.
Figure 6:
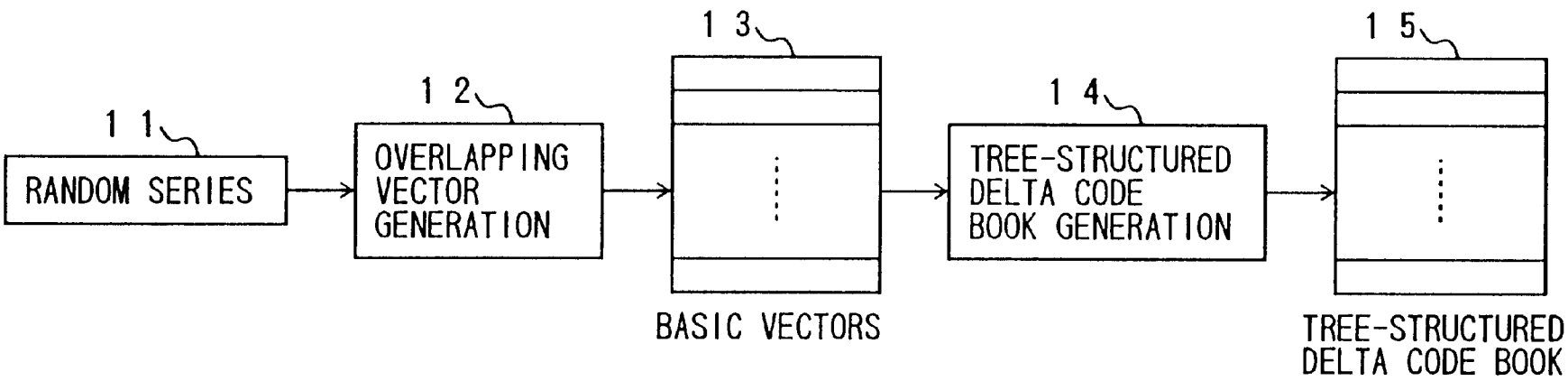
FIG. 6 is a block diagram showing an operating principle of a speech encoding and decoding apparatus according to a first embodiment of the present invention.

FIG. 6 is a block diagram showing an operating principle of a speech encoding and decoding apparatus according to a first embodiment of the present invention. The speech encoding and decoding apparatus comprises a random series 11, an overlapping vector generation unit 12, a basic vector unit 13, a tree-structured delta code book generation unit 14 and a tree-structured delta code book 15. The overlapping vector generation unit 12 of FIG. 6 corresponds to the basic vector generation unit 2 of FIG. 5. The tree-structured delta code book generation unit 14 corresponds to the code book generation unit 4 of FIG. 5. The tree-structured delta code book 15 corresponds to the code book 15 of FIG. 5. For example, like the basic vector unit 91 shown in FIG. 4A, the tree-structured code book 15 stores the initial vector $C_0$ and the delta vectors $\Delta C$–$\Delta C_9$.

Figure 7:
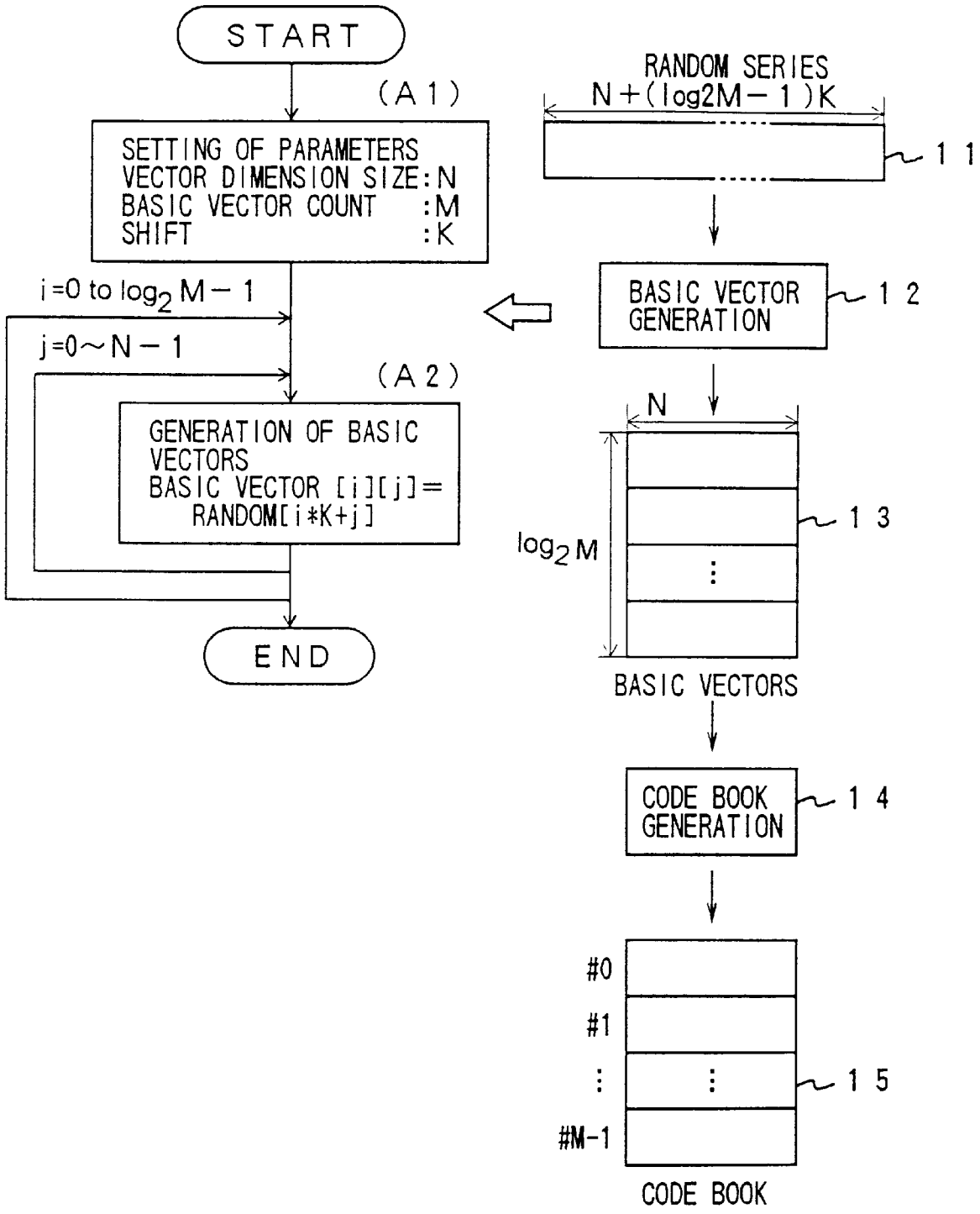
FIG. 7 is a flowchart showing an operation of the first embodiment.

FIG. 7 is a flowchart showing an operation of the first embodiment. Parameters are set such that the random series 11 has the vector dimension size N, the basic vector count M and the shift K (A1). The size of the random series is $N+(\log_2 M-1)K$. The basic vector generation unit 12 (the overlapping vector generation unit 12 of FIG. 6) generates basic vectors (A2) in accordance with a relation basic vector[$i$][$j$]=random series sample[$i$*K+$j$]

where $j$=0to N−1,$i$=0to $\log_2 M-1$.

The basic vector [i][j] indicates the jth sample of the ith basic vectors. The ith basic vectors are produced by retrieving 0–N−1 samples starting at the (i*K)th position in the random series 11. Therefore, by producing basic vectors for a range i=0 to $\log_2 M-1$, the basic vector unit 13 with the vector dimension size of N and the basic vector count of $\log_2 M$ is produced.

The code book generation unit 14 (the tree-structured delta code book generation unit 14 of FIG. 6) generates the code book 15 with the vector dimension size of N and the basic vector count of M (#0–#M−1). That is, by storing the random series 11 having a length of $N+(\log_2 M-1)$ in a buffer memory, the tree-structured delta code book can be generated. Assuming that the vector dimension size N=40, the basic vector count M=1024, and the shift K=1, the random series has a total of 49 words. Thus, the memory size is reduced to 1/836 as compared with the memory size (40960) of the prior art stochastic code book in which the code vectors of N=40 are stored in accordance with the basic vector count M=1024.

Figure 8:
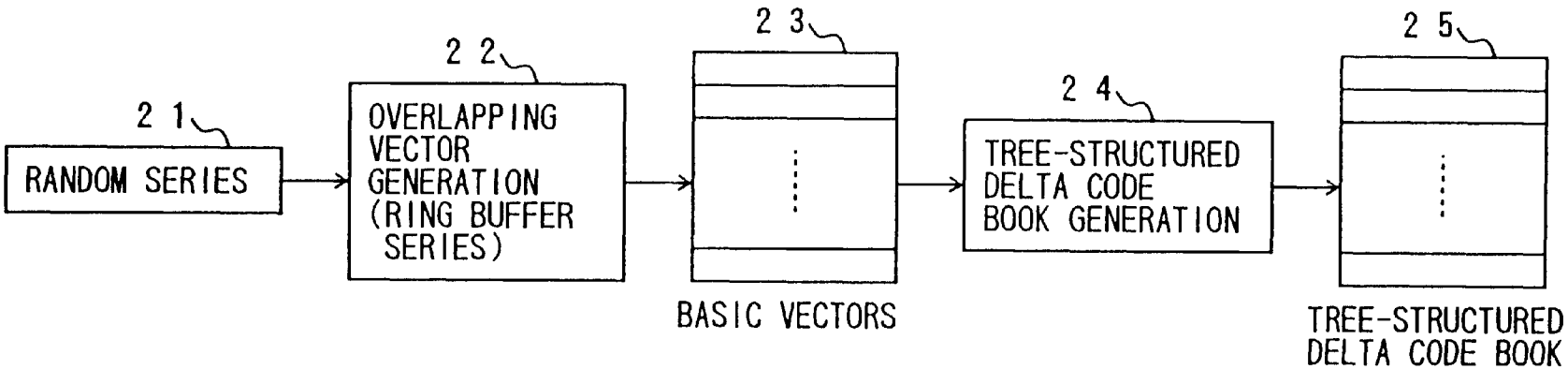
FIG. 8 is a block diagram showing an operating principle of a speech encoding and decoding apparatus according to a second embodiment of the present invention.

FIG. 8 is a block diagram showing an operating principle of a speech encoding and decoding apparatus according to a second embodiment of the present invention. The apparatus comprises a random series 21, an overlapping vector generation unit 22, a basic vector unit 23, a tree-structured delta code book generation unit 24 and a tree-structured delta code book 25. The overlapping vector generation unit 22 of FIG. 8 corresponds to the basic vector generation unit 2 of FIG. 5, the tree-structured delta code book generation unit 24 corresponds to the code book generation unit 4 of FIG. 5, and the tree-structured delta code book 25 corresponds to the code book 5 of FIG. 5.

The second embodiment employs a ring buffer memory to store a series. The functions of the overlapping vector generation unit 22 are substantially the same as that of the overlapping vector generation unit of FIG. 6. The overlapping vector generation unit 22 is unique in that it re-uses samples at the head of the random series 11 of FIG. 6 by storing a random series 21 in the ring buffer memory.

Figure 9:
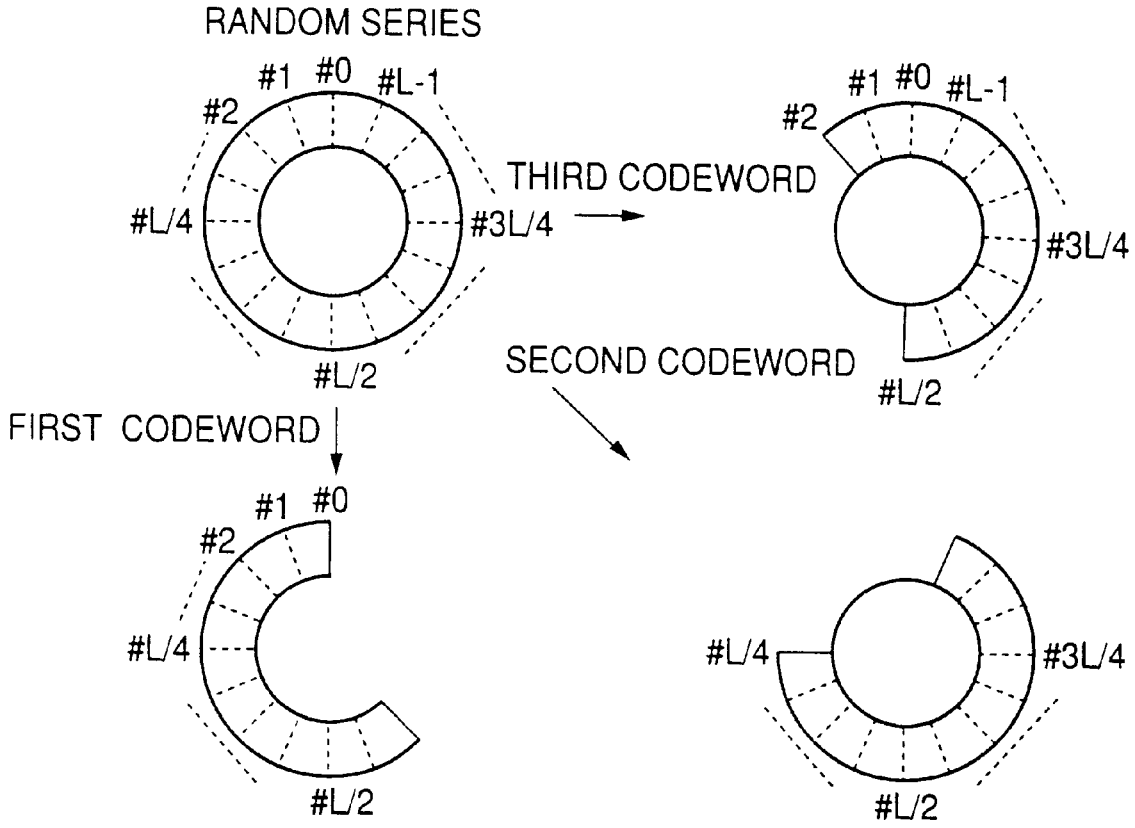
FIG. 9 shows a ring buffer memory used in the second embodiment.

FIG. 9 shows the ring buffer memory used in the second embodiment. The ring buffer memory stores a random series having a length L (#0 to #L−1). Basic vectors of the vector dimension size of n are generated such that the first codeword begins at #0, the second codeword begins at #L/4, the third codeword begins at #L/2. Each of the codewords has a portion thereof overlapping a corresponding portion of another codeword.

Figure 10:
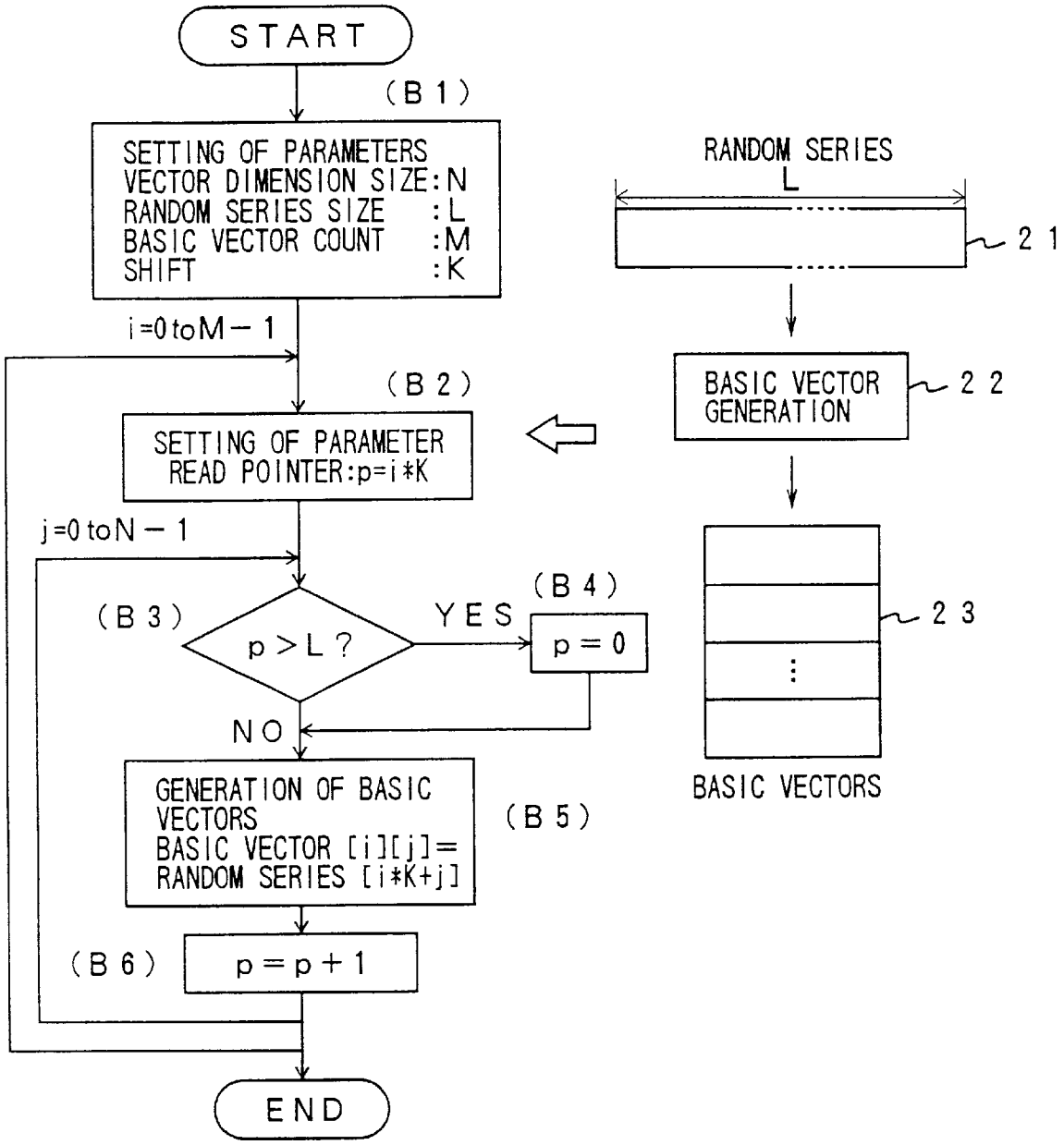
FIG. 10 is a flowchart showing an operation of the second embodiment.

FIG. 10 is a flowchart showing an operation of the second embodiment. The parameters are set such that the random series 21 has the vector dimension size N, the random series size L, the basic vector count M and the shift K (B1). The basic vector generation unit 22 (the overlapping vector generation unit 12 of FIG. 6) generates basic vectors, and the parameter is set such that a read pointer p=i*K (B2). A determination is made as to whether a relation p>L holds by comparing the read pointer p with the vector dimension size L of the random series 21 (B3).

A sample is read out starting at a position in the random series 21 indicated by the read pointer p. Therefore, when it is determined that p>L, it means that the read pointer p has passed a last position in the random series 21 having the length L and should be returned to the head of the random series 21. Therefore, p is set to 0 (B4).

The basic vectors are generated in accordance with the relation basic vector[*i*][*j*])=random series sample[*i**K+*j*]

where i=0 to M−1, j=0 to N−1. Every time one sample is read out starting at the position in the random series 21 indicated by the read pointer p, p is incremented such that p=p+1 (B6).

The basic vector [i][j] indicates the jth sample of the ith basic vector. For example, when the 0th basic vectors are generated, the read pointer p=i*K=0 so that samples are sequentially read starting at the head of the random series 21. The 0th basic vectors comprising N samples are generated by sequential reading in a read pointer range of p=0 to p=N−1. When the 1st basic vectors are generated p=i*K=1 so that samples are sequentially read starting at the second position in the random series 21. The 1st basic vectors comprising N samples are generated by sequential reading in a read pointer range of p=1 to p=N. Similarly, when the (M−1)th basic vectors are generated, p=1+K=M−1 so that samples are sequentially read starting at the Mth position in the random series 21. The Mth basic vectors comprising N samples are generated by sequential reading in a read pointer range of p=M−p=M+N−1.

The random series size L and the vector dimension size N may be equal to each other. For example, referring to FIG. 9 and assuming that L=N and K=1, the first codeword is retrieved at #0−#L−1, the second codeword is retrieved at #1−#0, the third codeword is retrieved #2−#1 so that basic vectors comprising L samples are generated. In this case, the parameters are set in step B1 such that N=L=M and K=1.

Assuming that the vector dimension size L is equal to 40, the random series 21 contains 40 words. That is the ring buffer memory may only have a capacity for 40 words. Accordingly, the memory size is reduced to approximately 1/1000 that of the prior art stochastic code book storing the code vectors of N=40 in accordance with the basic vector count M=1024 and having a memory size of 40960 words. It is possible to set L<N. In this case, given that L+2=N and K=1, the first codeword is retrieved by reading samples at #0−#L−1−#2 of the buffer memory, and the second codeword is retrieved by reading samples at #1−#L−1−#0−#3. It is also possible to provide the ring buffer memory with control means for ensuring that there is no correlation between the codewords.

Figure 11:
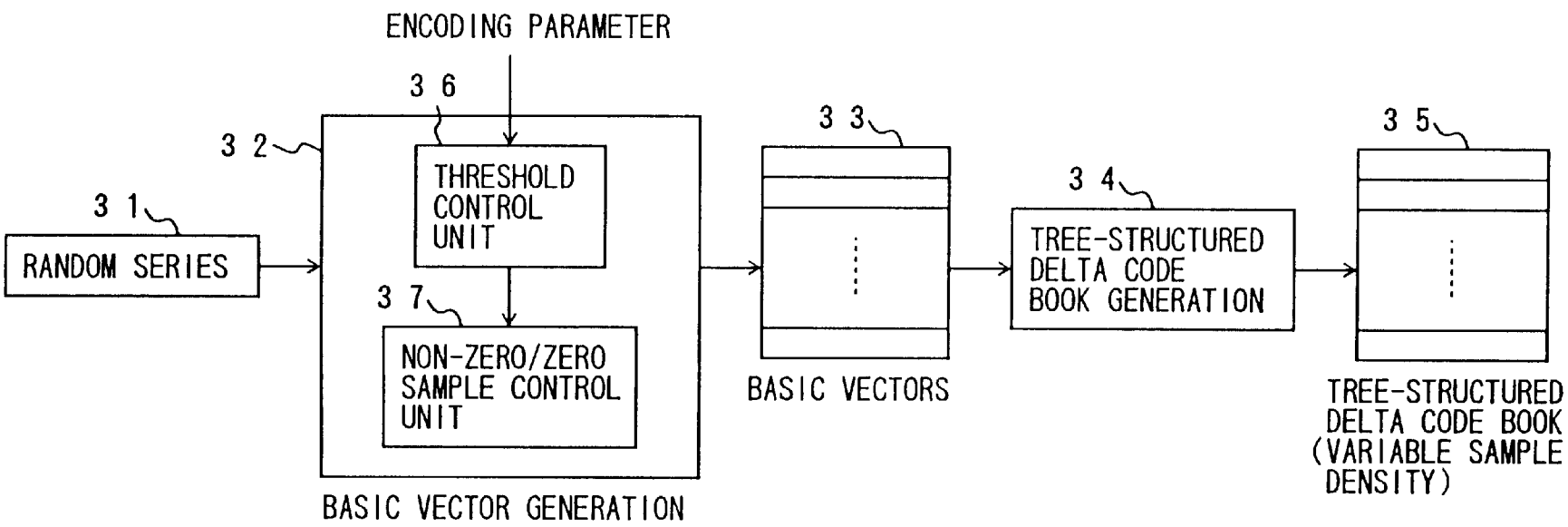
FIG. 11 is a block diagram showing an operating principle of an encoding and decoding apparatus according to a third embodiment of the present invention.

FIG. 11 is a block diagram showing an operating principle of an encoding and decoding apparatus according to a third embodiment of the present invention. The apparatus comprises a random series 31, a basic vector generation unit 32, a basic vector unit 33, a tree-structured delta code book generation unit 34, a tree-structured delta code book 35 with a variable sample density, a threshold control unit 36 and a non-zero/zero sample control unit 37. The random series 31 of FIG. 11 corresponds to the random series 1 of FIG. 5, the tree-structured delta code book generation unit 34 corresponds to the code book generation unit 4 of FIG. 5, and the tree-structured delta code book 35 corresponds to the code book 5 of FIG. 5.

The basic vector generation unit 32 includes the threshold control unit 36 and the non-zero/zero sample control unit 37. The basic vector generation unit 32 sets a threshold value as a function of an encoding parameter. The non-zero/zero sample control unit 37 compares the random series and the threshold value so as to effect non-zero/zero control. The tree-structured delta code book generation unit 34 operates in the same manner as the tree-structured delta code book generation unit 24 of FIG. 8 so as to generate the tree-structured delta code book 35. However, the tree-structured delta code book 35 has a variable sample density due to the non-zero/zero control effected by the non-zero/zero sample control unit 37. The encoding parameter fed to the threshold control unit 36 may be a parameter obtained in a preceding process for identifying the relevant code in the code book. In the case of decoding, the received encoding parameter may be used or the parameter obtained by re-analysis may be used.

Figure 12:
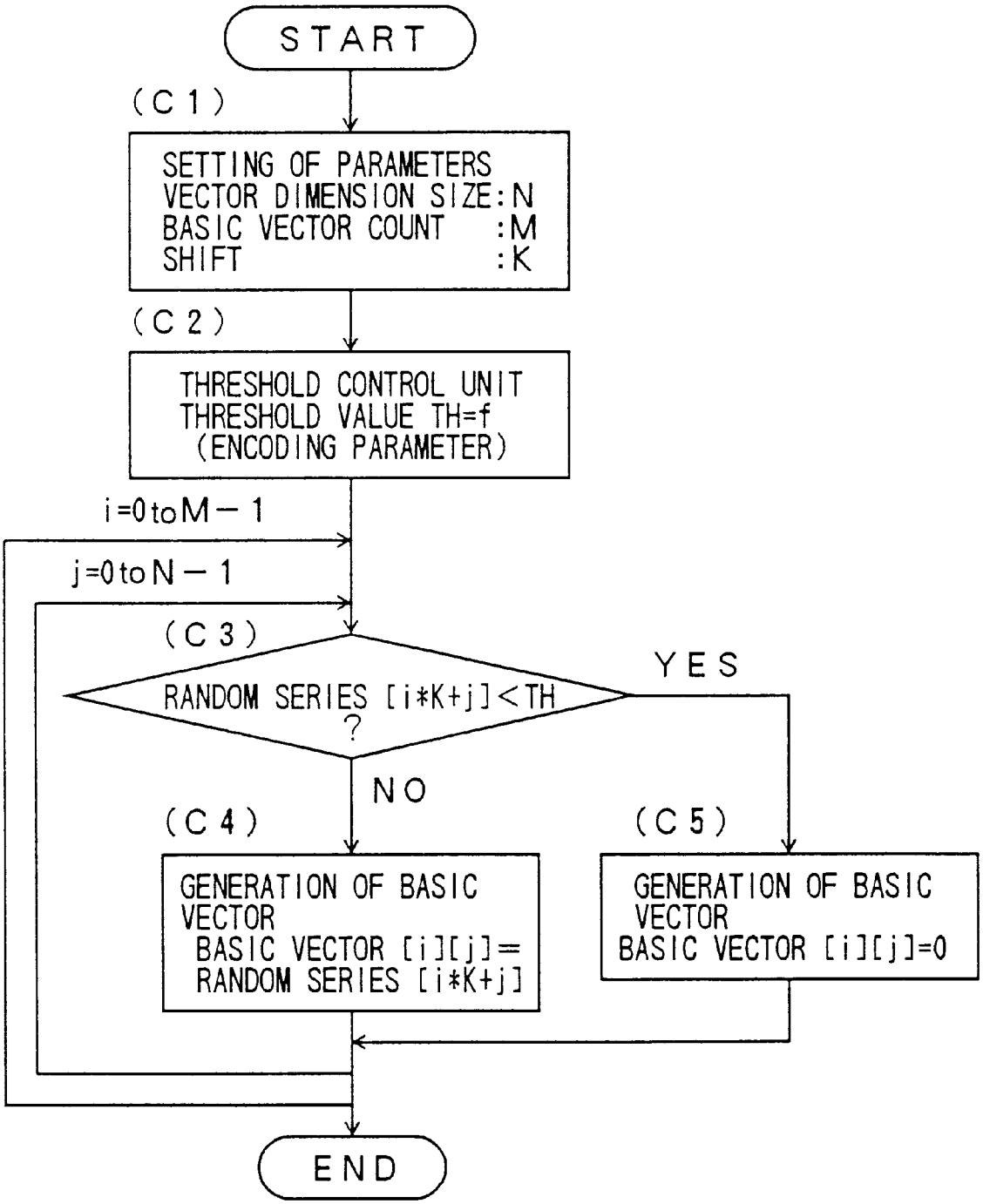
FIG. 12 is a flowchart showing an operation of the third embodiment.

FIG. 12 is a flowchart showing an operation of the third embodiment. The parameters are set such that the random series 31 has the vector dimension size of N, the basic vector count of M, and the shift of K (C1). Subsequently, the threshold control unit 36 of the basic vector generation unit 32 sets the threshold value as a function of the encoding parameter (C2). For example, if a pitch gain [0, 0, 1, 8] is used as the encoding parameter, the threshold value TH may be such that TH=pitch gain value/1.8.

The non-zero/zero sample control unit 37 executes steps (C3)–(C5). First, the non-zero/zero sample control unit 37 determines whether the random series sample [i*K+j]<TH holds (C3). If the random series sample [i*K+j] exceeds the threshold value, the random series sample [i*K+j] is retrieved as a basic vector (C4). If the random series sample [i*K+j] is smaller than the threshold value, the basic vector [i][j] is set to 0 (C5). This process is repeated for a range i=0 to M−1, and j=0 to N−1.

As a result, the basic vectors include zero-amplitude series. The basic vectors are extended by the tree-structured delta code book generation unit 34 so as to produce the tree-structured delta code book 35 with a variable density of non-zero samples. The tree-structured delta code book 35 thus produced covers a wide range of speech including voiced sounds for which a pulse excitation signal is most adapted, and unvoiced sounds for which a noise-like excitation signal is most adapted. The encoding parameter may be other than the aforementioned pitch gain. The threshold value TH may be a predetermined fixed value. The process of the non-zero/zero sample control unit 37 may be executed or may not be executed depending on the type of speech.

Figure 13:
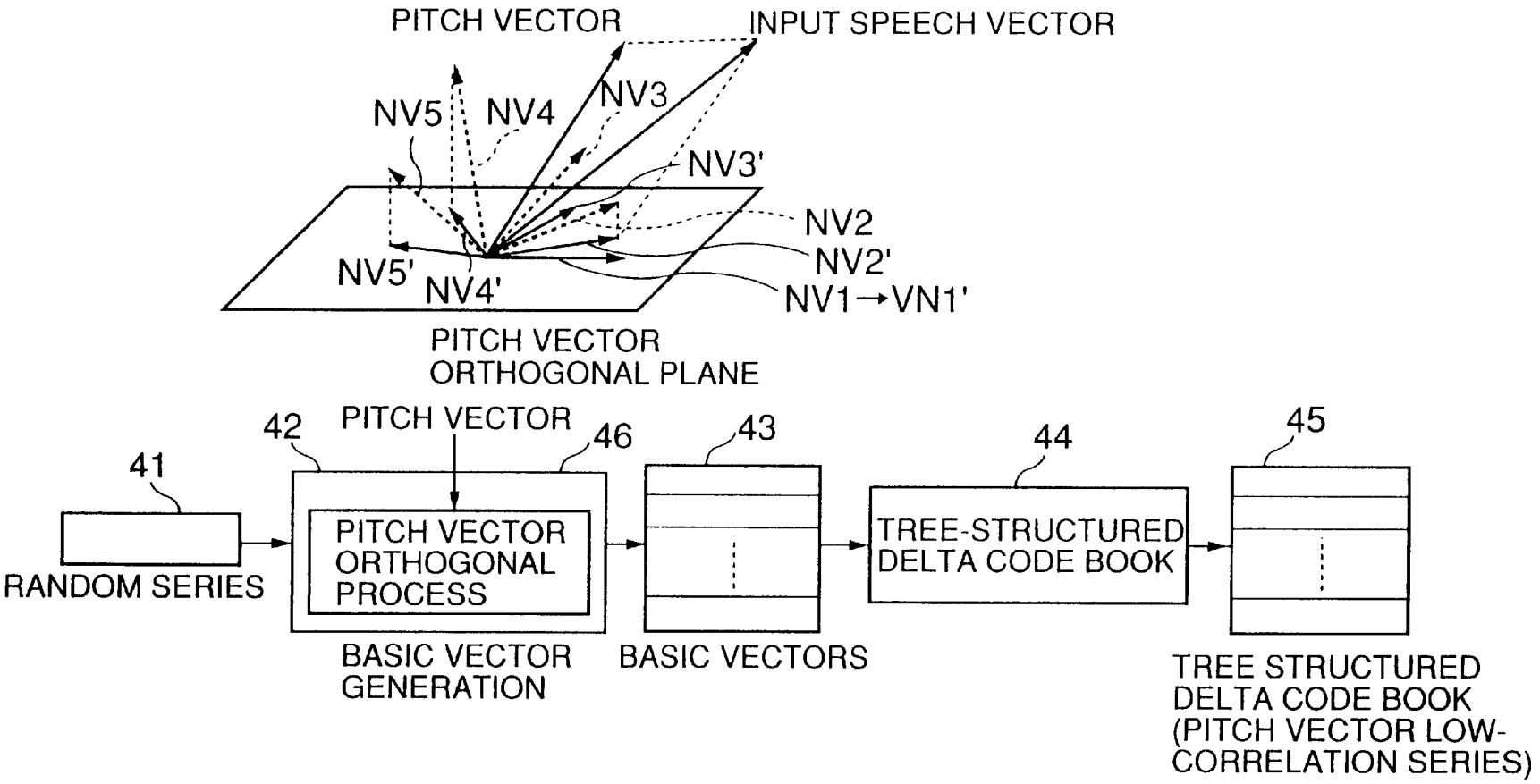
FIG. 13 shows an encoding and decoding apparatus according to a fourth embodiment of the present invention.

FIG. 13 shows an encoding and decoding apparatus according to a fourth embodiment of the present invention. The apparatus comprises a random series 41, a basic vector generation unit 42, a basic vector unit 43, a tree-structured delta code book generation unit 44, a tree-structured delta code book 45 including a series orthogonalized by a pitch vector and a pitch vector orthogonal process unit 46. The random series 41 in FIG. 13 corresponds to the random series 1 of FIG. 5, the basic vector generation unit 42 corresponds to the basic vector generation unit 2 of FIG. 5, the tree-structured delta code book generation unit 44 corresponds to the code book generation unit 4 of FIG. 5, and the tree-structured delta code book 45 corresponds to the code book 5 of FIG. 5.

Excitation signal identifying in CELP is a process for determining an input speech vector based on the pitch vector and the stochastic vector. The pitch vector can be obtained by searching for a code vector or by a pre-encoding process on the speech signal. By forming stochastic vectors using orthogonal vectors having no correlation with the pitch vector, efficient vector quantization is possible.

Accordingly, the pitch vector orthogonal process unit 46 subjects the basic vector to an orthogonal process on the basis of the pitch vector. For example, in a process whereby a pitch vector for an input speech vector is first produced and the input speech vector is then identified based on the pitch vector and the stochastic vector, stochastic vectors NV1'–NV5' indicated by solid lines and projected on the pitch vector orthogonal plane are obtained for the respective stochastic vectors NV1–NV5 indicated by dotted lines. In the case of decoding, the pitch orthogonal stochastic vector is obtained using the received pitch vector and the pitch vector obtained by re-analysis.

Figure 14:
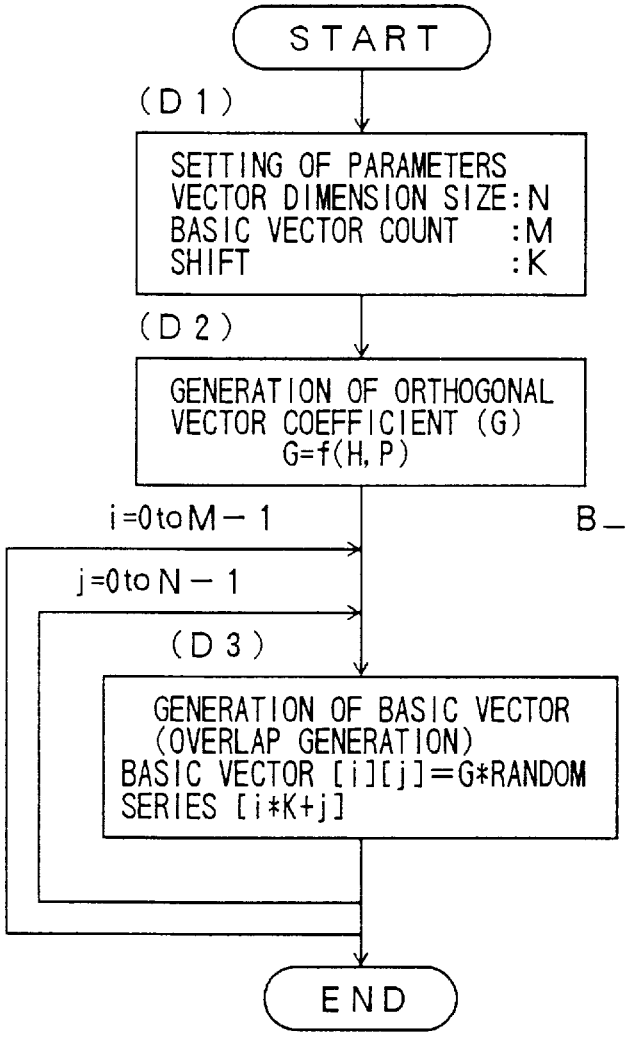
FIG. 14 is a flowchart showing an operation according to the fourth embodiment.

FIG. 14 is a flowchart showing an operation according to the fourth embodiment. The parameters are set such that the random series 41 has the vector dimension size of N, the basic vector count of M, and the shift of K (D1). The pitch vector orthogonal process unit 46 obtains an orthogonal vector coefficient G as per G=f(H,P), where H indicates a filter impulse response matrix weighted according to the human auditory response, and P indicates a pitch vector (D2). The basic vectors having the vector dimension size of N and the basic vector count of M are generated for a range of j=0 to N−1 and i=0 to M−1. More specifically, the basic vectors are generated according to a relation basic vector[$i$][$j$]=G*random series sample[$i$*K+$j$]

according to an overlapping generation process (D3).

The formula given beside the flowchart shows how the pitch orthogonal basic vectors are generated according to the Gram-Schmidt orthogonal method, where B_orth indicates a pitch orthogonal basic vector, B indicates a basic vector, H indicates a filter impulse response matrix weighted according to the human auditory response, and P indicates a pitch vector. The pitch orthogonal basic vector B_orth is obtained as per B_orth=GB. The orthogonal vector coefficient G is obtained according to a relation $$G=[1-(P^{T}H^{T}HP)/(HP)^{T}(HP)]$$

Thus, the pitch orthogonal basic vectors having no correlation with the pitch vector are produced.

Figure 15:
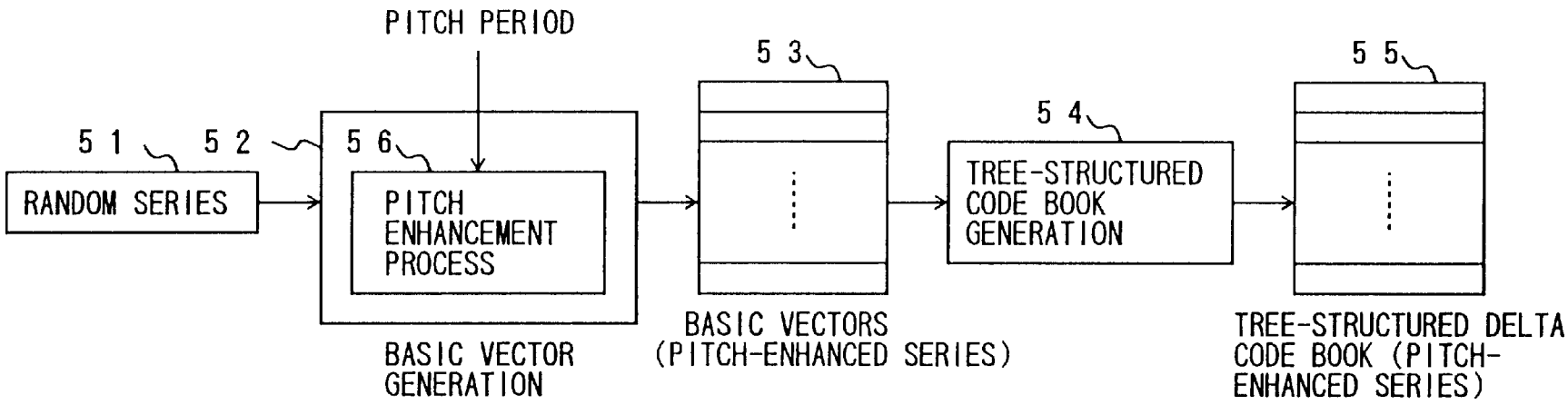
FIG. 15 is a block diagram showing an operating principle of an encoding and decoding apparatus according to a fifth embodiment of the present invention.

FIG. 15 is a block diagram showing an operating principle of an encoding and decoding apparatus according to a fifth embodiment of the present invention. The apparatus comprises a random series 51, a basic vector generation unit 52, a basic vector unit 53, a tree-structured delta code book generation unit 54, a tree-structured delta code book 55 containing pitch-enhanced series and a pitch enhancement process unit 56. The random series 51 corresponds to the random series 1 of FIG. 5, the basic vector generation unit 52 corresponds to the basic vector generation unit 2 of FIG. 5, the tree-structured delta code book generation unit 54 corresponds to the tree-structured delta code book generation unit 4 of FIG. 5, and the tree-structured delta code book 55 corresponds to the tree-structured delta code book 5 of FIG. 5

The pitch enhancement process unit 56 effects a pitch enhancement process when a pitch period obtained in a preceding stage included in the process of identifying the code is shorter than an analyzed frame length. By causing the stochastic code book for identifying a stochastic signal to have a pitch period, it is expected that performance of the encoding and decoding apparatus is improved for voiced sounds (stationary portions of the speech). In the case of decoding, the received pitch period or the pitch period obtained in a re-analysis is employed.

Figure 16:
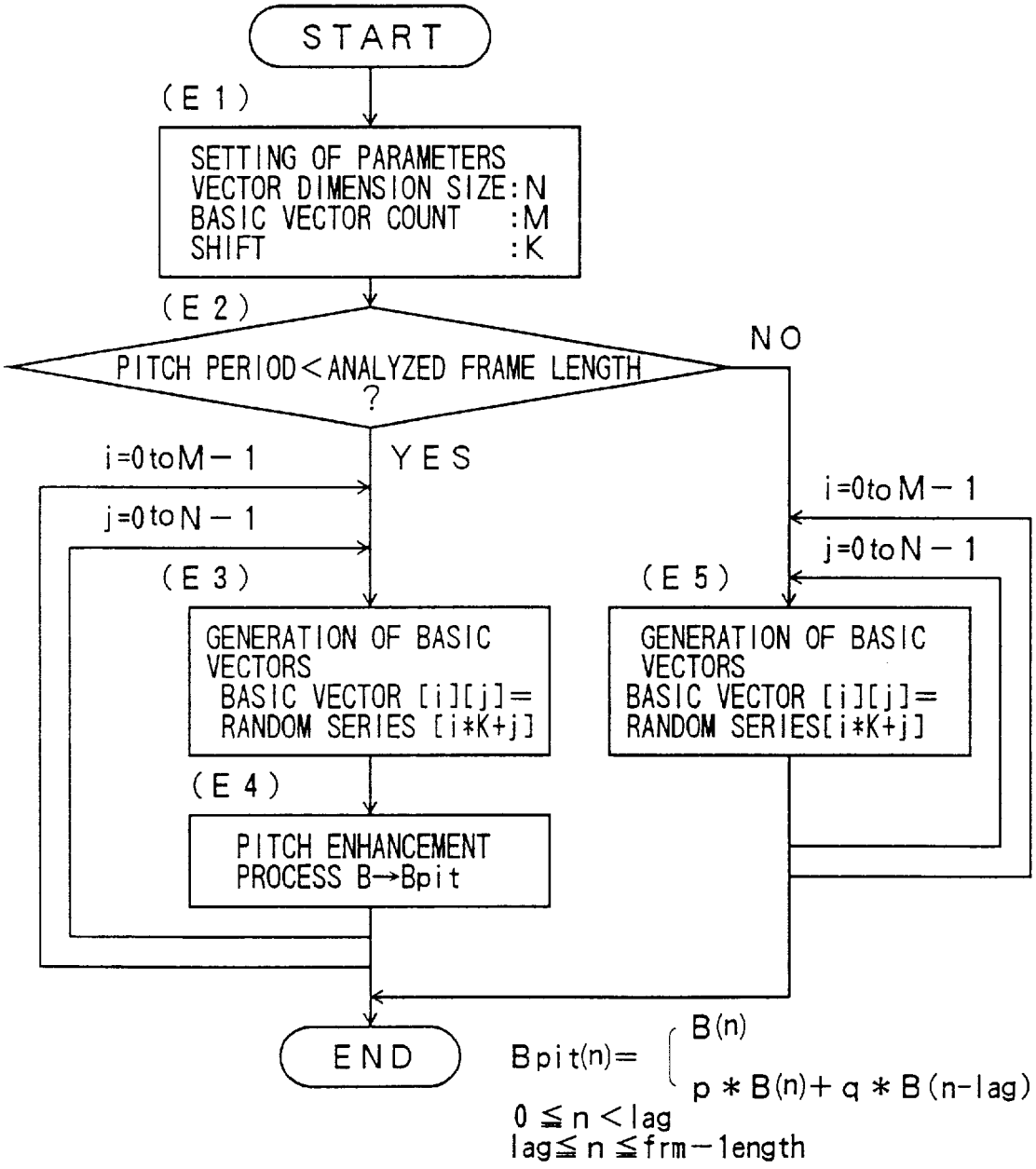
FIG. 16 is a flowchart for an operation of the fifth embodiment.

FIG. 16 is a flowchart for an operation of the fifth embodiment. The parameters are set such that the random series 51 has the vector dimension size of N, the basic vector count of M, and the shift of K (E1). A comparison is made between the pitch period and the analyzed frame length (E2). Basic vectors are generated according to a relation basic vector[$i$][$j$]=random series sample[$i$*K+$j$](E3 and E5).

When the pitch period is shorter than the analyzed frame length, the pitch enhancement process is executed (E4).

The pitch-enhanced basic vector Bpit(n) is obtained according to relations $$\mathrm{Bpit}(n)=\mathrm{B}(n)\ (0\leqq n\leqq \mathrm{lag})$$

$$\mathrm{Bpit}(n)=p*\mathrm{B}(n)+q*\mathrm{B}(n-\mathrm{lag})\ (\mathrm{lag}\leqq n\leqq \mathrm{frm-length})$$

where B indicates the basic vector [i][j], lag indicates a pitch period, frm−length indicates a frame length, and p and q indicate pitch enhancement filter coefficients.

The basic vectors subject to the pitch enhancement process are extended by the tree-structured delta code book generation unit 54 so as to produce the tree-structured delta code book 55. The tree-structured delta code book 55 may be a stochastic code book. The pitch enhancement process may be executed for one or both of the encoding process and the decoding process so that the quality of the decoded and reconstructed speech signal is improved.

The present invention is not limited to the above-described embodiments, and variations and modifications may be made without departing from the scope of the present invention.

What is claimed is:

1. A speech signal encoding decoding method using A-b-S vector quantization comprising the steps of:

generating basic vectors having a predetermined vector dimension size by applying an arbitrary shift to a code sample retrieved from a random series of code samples; and generating code vectors constituting a code book, by extending said basic vectors according to a structuring process; and storing the random series in a ring buffer memory, and generating the basic vectors from the random series stored in the ring buffer memory, according to an overlapping vector generation process.

2. A speech signal encoding decoding method using A-b-S vector quantization comprising the steps of:

generating basic vectors having a predetermined vector dimension size by applying an arbitrary shift to a code sample retrieved from a random series of code samples; and generating code vectors constituting a code book, by extending said basic vectors according to a structuring process;

comparing each of code series retrieved from the random series and having the vector dimension size, with a threshold value, and controlling a number of zero-amplitude samples in the basic vectors in accordance with a result of the comparison; and setting the threshold value as a function of a parameter obtained as a result of analysis in a preceding stage included in a process of identifying a code in the code book that matches an input signal.

3. A speech signal encoding decoding method using A-b-S vector quantization comprising the steps of:

generating basic vectors having a predetermined vector dimension size by applying an arbitrary shift to a code sample retrieved from a random series of code samples;

generating code vectors constituting a code book, by extending said basic vectors according to a structuring process; and comparing each of code series retrieved from the random series and having the vector dimension size, with a threshold value, and controlling a number of zero-amplitude samples in the basic vectors in accordance with a result of the comparison; and setting the threshold value on the basis of one of a transmitted parameter and a parameter obtained by reanalysis in a decoding process, comparing the threshold value with each of code series retrieved from the random series and having the vector dimension size, and controlling a number of zero-amplitude samples in the basic vectors in accordance with a result of comparison.

4. A speech signal encoding decoding method using A-b-S vector quantization comprising the steps of:

generating basic vectors having a predetermined vector dimension size by applying an arbitrary shift to a code sample retrieved from a random series of code samples;

generating code vectors constituting a code book, by extending said basic vectors according to a structuring process; and processing code series retrieved from the random series and each having the vector dimension size, according to a pitch vector, and generating the basic vectors as pitch orthogonal vectors having no correlation with the pitch vector.

5. A speech signal encoding decoding method using A-b-S vector quantization comprising the steps of:

generating basic vectors having a predetermined vector dimension size by applying an arbitrary shift to a code sample retrieved from a random series of code samples;

generating code vectors constituting a code book, by extending said basic vectors according to a structuring process; and processing code series retrieved from the random series and each having the vector dimension size, according to a pitch period, and generating the basic vectors as pitch-enhanced vectors.

6. A speech signal encoding and decoding apparatus using A-b-S vector quantization comprising:

a buffer memory for storing a random series of code samples;

a basic vector generation unit for generating basic vectors from code series retrieved from said buffer memory, on the basis of parameters including a vector dimension size and a shift, and according to an overlapping vector generation process;

a code book generation unit for generating a code book by extending the basic vectors generated by said basic vector generation unit, wherein said buffer memory is a ring buffer memory.

7. A speech signal encoding and decoding apparatus using A-b-S vector quantization comprising:

a buffer memory for storing a random series of code samples;

a basic vector generation unit for generating basic vectors from code series retrieved from said buffer memory, on the basis of parameters including a vector dimension size and a shift, and according to an overlapping vector generation process;

a code book generation unit for generating a code book by extending the basic vectors generated by said basic vector generation unit, wherein said basic vector generation unit includes a pitch vector orthogonal processing part for generating the basic vectors as vectors having no correlation with a pitch vector.

8. A speech signal encoding and decoding apparatus using A-b-S vector quantization comprising:

a buffer memory for storing a random series of code samples;

a basic vector generation unit for generating basic vectors from code series retrieved from said buffer memory, on the basis of parameters including a vector dimension size and a shift, and according to an overlapping vector generation process;

a code book generation unit for generating a code book by extending the basic vectors generated by said basic vector generation unit, wherein said basic vector generation unit includes a pitch enhancement process unit for subjecting each of code series retrieved from the random series stored in said buffer memory to a pitch enhancement process so as to generate the basic vectors as pitch-enhanced vectors.

* * * * *